US005320404A

United States Patent [19]

Le Gal

[11] Patent Number: 5,320,404

[45] Date of Patent: Jun. 14, 1994

[54] FURNITURE, SUCH AS CHAIR, EASY CHAIR OR TABLE HAVING AN UNDERFRAME MADE UP OF JOINTED CROSS-PIECES, WHICH HOLDS A SUPPORT

[75] Inventor: Yann Le Gal, Voreppe, France

[73] Assignee: Lafuma S.A., France

[21] Appl. No.: 845,014

[22] Filed: Mar. 3, 1992

[30] Foreign Application Priority Data

Mar. 7, 1991 [FR] France ..... 91 03000

[51] Int. Cl.[5] ..... A47C 4/00

[52] U.S. Cl. ..... 297/16.2; 297/440.11; 297/452.13

[58] Field of Search ..... 297/16, 31, 42, 45, 297/218, 219, 229, 441, 457; 403/223, 224, 225, 291, 292, 298

[56] References Cited

U.S. PATENT DOCUMENTS 2,691,410 10/1954 Boucher ..... 297/441 X
3,767,233 10/1973 Hodge ..... 403/292 X
3,838,883 10/1974 Machen ..... 297/457 X
4,204,284 5/1980 Koeneman ..... 403/224 X
4,251,106 2/1981 Gilbert ..... 297/457 X
4,583,778 4/1986 Liebhold ..... 297/441 X
4,603,904 8/1986 Tolleson et al. ..... 403/223 X

FOREIGN PATENT DOCUMENTS 1443297 5/1966 France .
2422367 11/1979 France .

*Primary Examiner*—Laurie K. Crammer
*Attorney, Agent, or Firm*—Harris Beach & Wilcox

[57] ABSTRACT

Item of furniture, such as an easy chair, chair or table comprised of an underframe and a support designed to rest on the underframe. The underframe is made up of at least three crosspieces which are formed of jointed struts and whose ends are connected to one another, with two ends to each connection. Each connection is via an elastic, deformable sleeve of unitary construction, with the lower sleeves resting on the ground and part of the upper sleeve assembly holding the support.

20 Claims, 7 Drawing Sheets

FURNITURE, SUCH AS CHAIR, EASY CHAIR OR TABLE HAVING AN UNDERFRAME MADE UP OF JOINTED CROSS-PIECES, WHICH HOLDS A SUPPORT

BACKGROUND OF THE INVENTION

The invention concerns a new type of furniture, such as chair, easy chair or table, of the type having an underframe made up of jointed cross-pieces, which holds a support that forms a back or table top. For a long time, easy chairs known as AA have been known that are made up of four flat rigid tubular cross-pieces, rounded off at the ends, on which there is a piece of cloth forming the back and seat. Even though widely used, this type of chair has the disadvantage that it can not be folded, but can only be disassembled.

It was then proposed that on each of the ends of the cross-pieces, straps or mechanical hinges be fitted that are joined to each other. This arrangement, which is complicated on the mechanical plane, is costly and besides, makes the operation of folding or unfolding difficult. In addition, the straps or hinges continuously rub on the ground, which digs it up (see for example U.S. Pat. No. 2,691,410).

SUMMARY OF THE INVENTION

The invention alleviates these inconveniences. It provides a piece of furniture of the type in question in which the underframe is made up cross-pieces, on which a support is mounted which is pliable, that is easy to fold and unfold without digging up the ground.

This piece of furniture, which includes:

an underframe made up of at least three cross-pieces formed of jointed struts connected at their ends, two by two;

a support intended to rest on the underframe, characterized by the fact that the free ends of two tubular struts, each belonging to two different cross-pieces, but working together, are attached to each other by an elastic, deformable sleeve of unitary construction, fitted into each of these two ends in such a way that all of the lower sleeves form the support point on the ground, while part of the upper sleeve assembly holds the support.

Advantageously, in practice:

the sleeve of unitary construction is made of deformable plastic material, exhibiting a strong elastic return force, able to resist bad weather, differences in temperature and abrasion; advantageously, this sleeve is of thermoplastic polyurethane, of elastomer, of PVC; it is important that it be mechanically resistant and that it returns simply and without deformation to its initial position;

the deformable elastic sleeve of unitary construction is made up of a monobloc molded part, made up of a cylindrical body of which the diameter essentially corresponds to the external diameter of the struts, this cylindrical body having at each of its two ends a joining piece like a sawed-off cone attached to this body by its small base, the end of the struts then being contracted by one of these joining pieces in the shape of a sawed-off cone;

the tubular struts are of aluminum, of steel, indeed of composite material, and notably of plastic material.

In a first embodiment, the piece of furniture is a seat that has four cross-pieces that work together with two other cross-pieces, the two struts of the two cross-pieces, front and rear respectively, being equal; but the struts of the front cross-piece being smaller than the struts of the rear cross-piece, while the struts of the two side cross-pieces are not equal, each cross-piece having a small strut basically equal to the struts of the front cross-piece and a large strut basically equal to the struts of the rear cross-piece.

In this embodiment, the support is a trapezoidal piece of cloth, of which the small base is arranged toward the front and the large base toward the rear, this piece of cloth being attached to the four upper struts by means of gussets prepared for this purpose at each of the corners of the trapezoid. Each gusset thus exhibits a quick attachment device provided on the side toward the cloth and on the side toward the gusset in such a way as to enclose each of the upper struts.

In a second embodiment, the seat is a tripod and is made up of three cross-pieces, of which each of the struts works together with the two struts of the two other cross-pieces, the struts of the front cross-piece being equal, the two side cross-pieces each exhibiting a small strut intended to be directed toward the front and a large strut intended to be directed toward the rear, the support is then a triangular piece of cloth, of which the base is directed toward the front and the top toward the back of the gussets analogous to the preceding gussets of the trapezoidal piece of cloth.

In a third embodiment, the piece of furniture is a table in which the underframe is made up of four cross-pieces of which the struts are equal to each other and of which the support forms a table top and is made up of a succession of parallel bars that can be rolled up, the internal side of the top exhibiting a means of attaching to the upper struts to thus define different positioning heights of the top, the assembly thus being advantageously foldable.

The manner in which the invention may be realized and the advantages that derive from it will be better illustrated in the examples that follow, with reference to the figures attached.

BRIEF DESCRIPTION OF THE DRAWINGS

FIG. 1 shows an overall perspective view of an underframe for a seat with four legs, while

DESCRIPTION OF THE INVENTION

Figure 1:
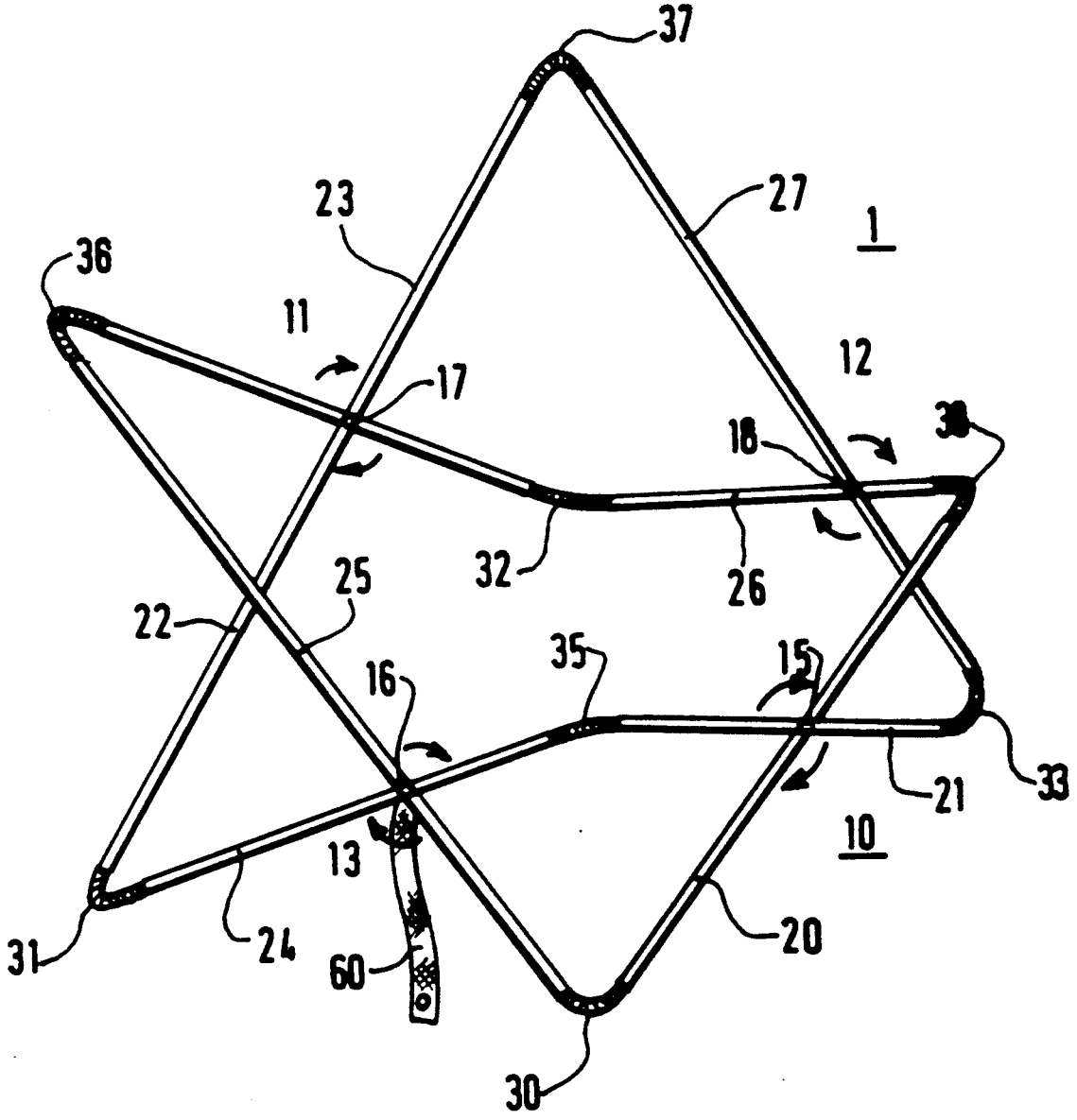
Figure 2:
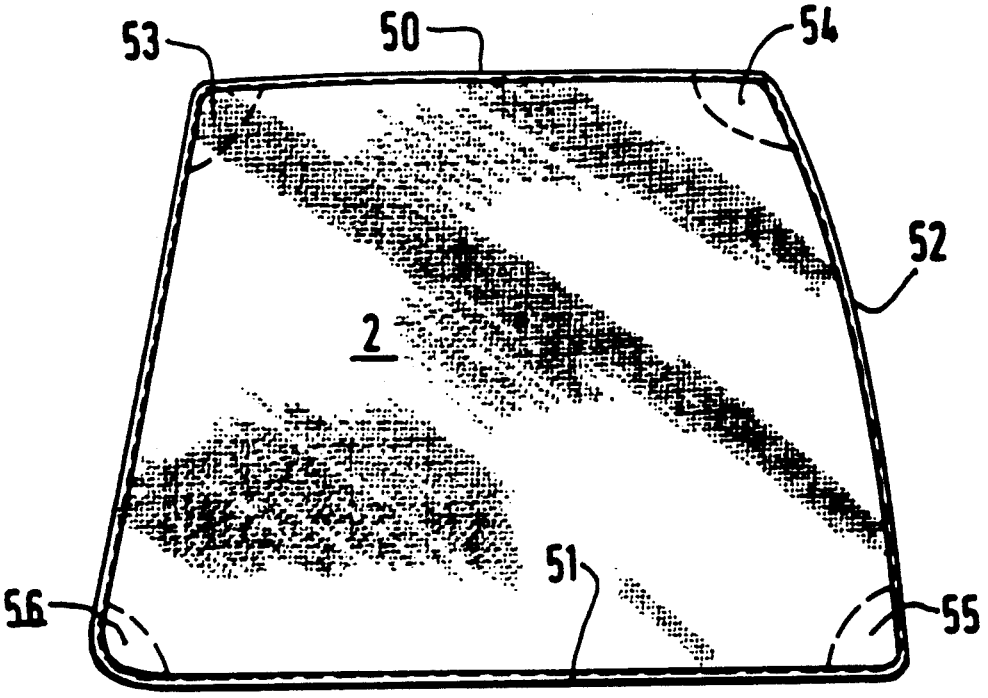
FIG. 2 shows a trapezoidal support cloth.

In the first embodiment shown in FIGS. 1 to 7, the furniture according to the invention is an easy chair with four legs. This easy chair essentially includes a frame indicated by the general reference (1) shown in detail in FIG. 1, intended to hold a support indicated by the general reference (2) in a generally trapezoidal form, of cloth, forming back and seat, shown in plane view in FIG. 2.

The frame (1) characteristic of the invention basically includes four cross-pieces, respectively the front (10), rear (11), right side (12), left side (13), each of these cross-pieces being made up of two tubular struts joined in their center (15,16,17,18), in which:

- the front cross-piece (10) is made up of two equal struts, respectively (20) and (21);
- the rear cross-piece (11) is also formed of two struts, respectively (22,23), equal, joined at (17), larger than (20,21);
- while the two side cross-pieces (12,13) are each made up of two struts, respectively (24,26) equal to (20,21) and (25,27) equal to (22,23).

According to an essential characteristic of the invention, the ends of the two struts are connected to each other by elastic deformable sleeves, respectively:

- the lower sleeves (30,31,32,33) intended to form the four legs and forming a support point on the ground;
- the upper sleeves (35,36,37,38) the assembly of which is intended to hold the cloth (2).

These characteristic sleeves of unitary construction (31-38) are made up of a cylinder of rubber of elastomer reinforced by textile fiber, fitted by force or contraction on the ends of the struts (1,27). Advantageously, these sleeves are solid and preferably molded. It is important that they be mechanically resistant and return easily and without deformation to their initial position, i.e. with a minimum of set or hysteresis.

Figure 4:
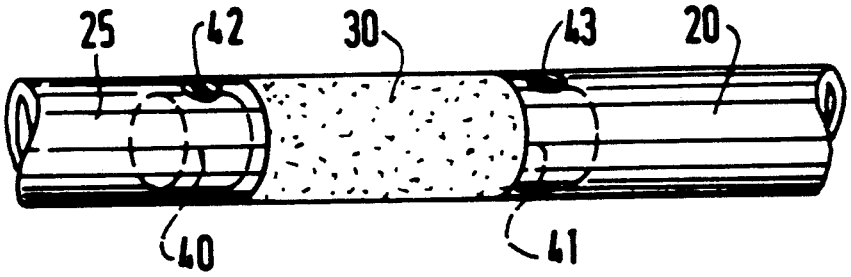
FIG. 4 shows a first embodiment of an elastic joining sleeve of unitary construction and FIG. 5 another embodiment of this sleeve.

In a first embodiment shown in FIG. 4, these sleeves (30) have at each end (40,41) a portion that is also cylindrical (40,41), of which the diameter corresponds essentially to the interior diameter of the struts. These ends (40,41) are then force-fitted into the corresponding struts (20,25) and are held in place by a stay (42,43).

Figure 5:
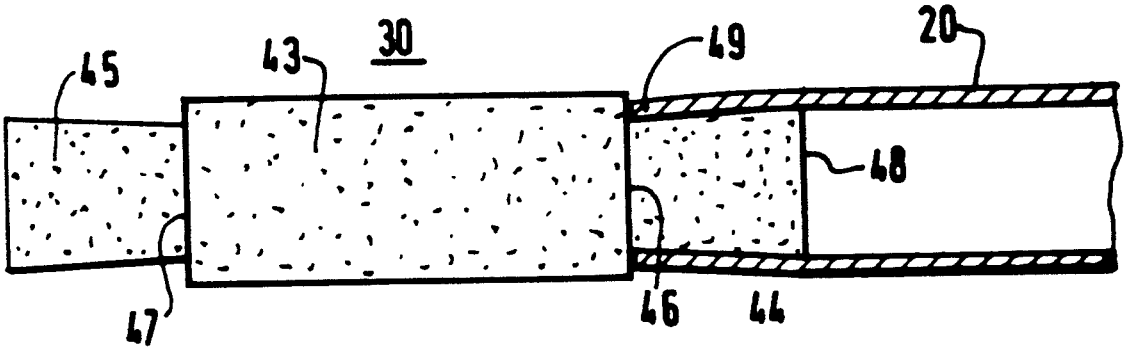
Figure 6:
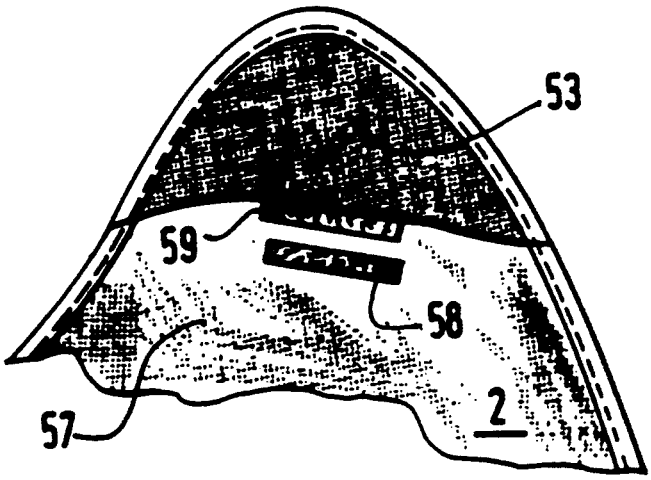
FIG. 6 shows in detail the construction of a gusset.
Figure 7:
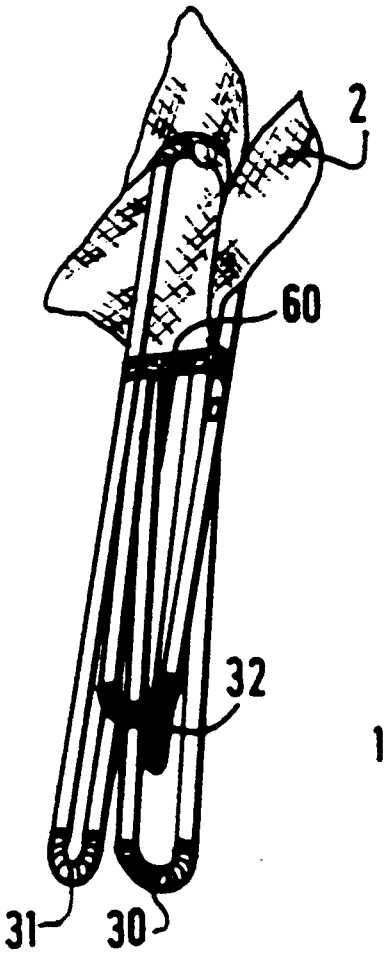
FIG. 7 shows the easy chair from FIG. 3, folded.

In an advantageous embodiment shown in FIG. 5, the sleeve (30) contains a solid cylindrical body (43) of which the diameter essentially corresponds to the exterior diameter of the struts, for example (20). This body (43) has, at each of its two ends, a joining piece in the shape of a sawed-off cone (44,45) connected to the body at its small base (46,47). The large base (48) has a diameter slightly larger than the internal diameter of the corresponding strut (20), which permits force fitting, then to assure the that the assembly is maintained, all that is necessary is to contract the end (49) of the corresponding tube (20) on the small sawed-off portion (46), for example by using a press. Since the diameter of the body (43) is essentially the same as that of the strut, angles that jut out are thus avoided, which sometimes cause small wounds, but which above all can cause tears in the cloth.

The support cloth (2) (see FIGS. 2 and 6), has a generally trapezoidal shape, of which the small base (50) is intended to work together with the front upper struts (35,38), while the large base (51) works together with the rear upper struts (36,37). The hem (52) of this cloth exhibits an overcast seam and each of the corners (53,54,55,56) exhibits a gusset shown in detail in FIG. 6, intended to work together with the upper sleeves (35–38). The side (57) toward the cloth (2) has, in the area of the gusset (53), a quick connect element, for example male (58) intended to work together with a corresponding element, for example female (59) mounted for this purpose on the side toward the gusset (53). All that is necessary is to introduce the gusset (53) onto the corresponding sleeve (35), and then to enclose this sleeve (35) by the complementary fastening devices (58,59) for example of the fastening velour type known under the trade name VELCRO.

The joining axes (15,16,17,18) of the struts may be made of any known material, for example by means of a riveted axis. Advantageously, one of these axes, for example (16), exhibits a strap (60) intended to insure that the assembly is maintained in a completely folded posi7 tion (see FIGS. 1 and 7).

Figure 3:
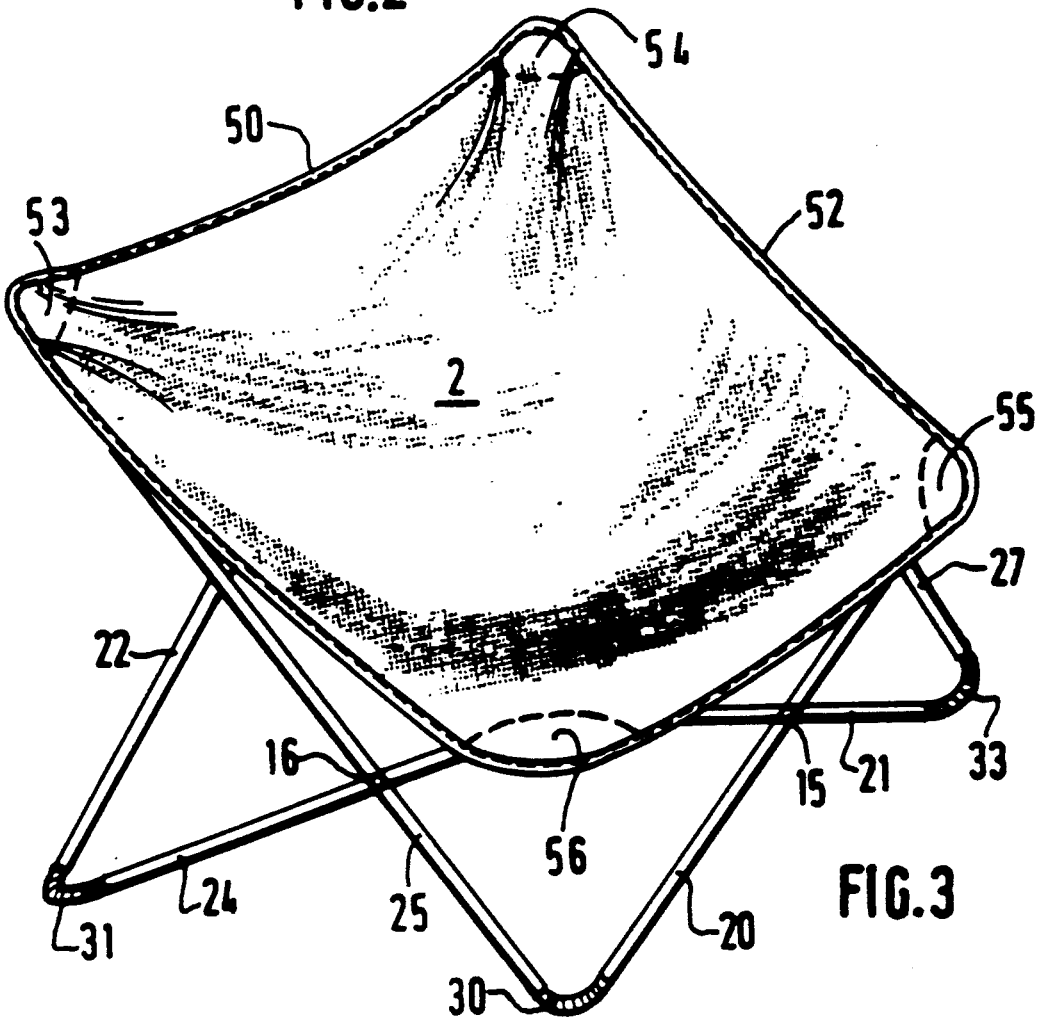
FIG. 3 is an overall perspective view of an easy chair of this type with four legs.

It is easily understood that the assembly shown in FIGS. 1 and 3 is easy to fold up, even leaving the cloth (2) in place. All that is necessary is to close the perimeter formed by each of the cross-piece struts in order to place them in the position shown in FIG. 7, and to maintain the assembly using the strap (60) which will engage on an axis that sticks out provided for this purpose on the joint concerned (16).

Figure 8:
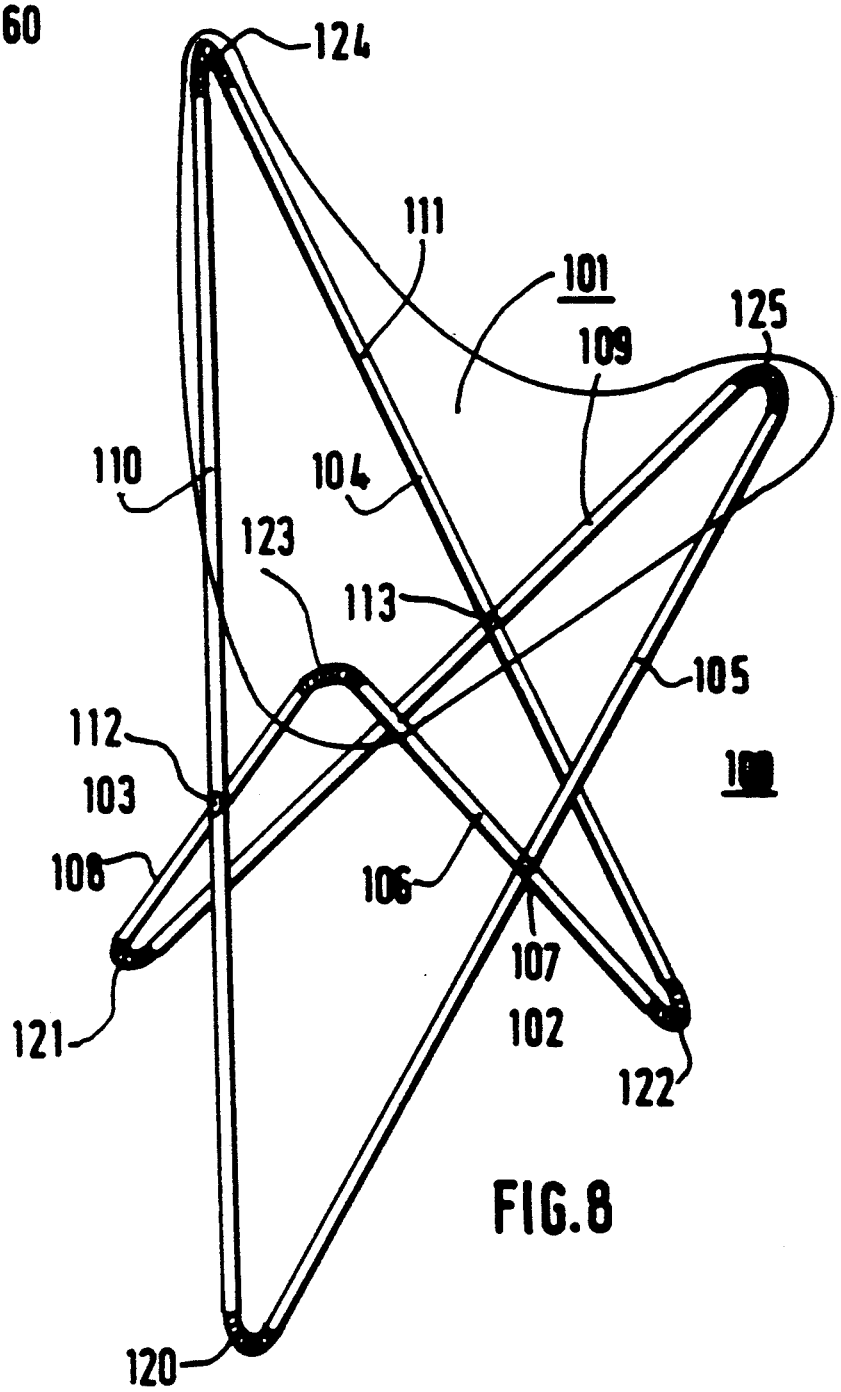
FIG. 8 shows another embodiment of a tripod seat.

In a second embodiment, the furniture is a tripod seat shown in FIG. 8 made up of an underframe indicated by the general reference (100) and a triangular support cloth (101) made in a manner analogous to the cloth (2), the general form of which is triangular and not trapezoi7 dal and of which the base is intended to work together with the front and the point with the back.

The underframe (100) includes three cross-pieces, respectively (102,103,104) and namely:

- the front cross-piece (102) of two struts (105,106) joined in the middle (107);
- while the two side cross-pieces (103,104) are made up of two small struts (108,109) equal to (105,106) and of two large struts (110,111), each of which are joined two by two at (112,113).

The cross-pieces (102,103,104) each work together with the two other cross-pieces by means of sleeves, respectively:

- the three lower sleeves (120,121,122), intended to form a support point on the ground,
- and the three upper sleeves (123,124,125) intended to hold the gussets placed at corners of the triangular support cloth (101).

The sleeves, the lower (120,121,122) and upper (123,124,125) respectively, are analogous to the preceding sleeves (30–38).

Figure 9:
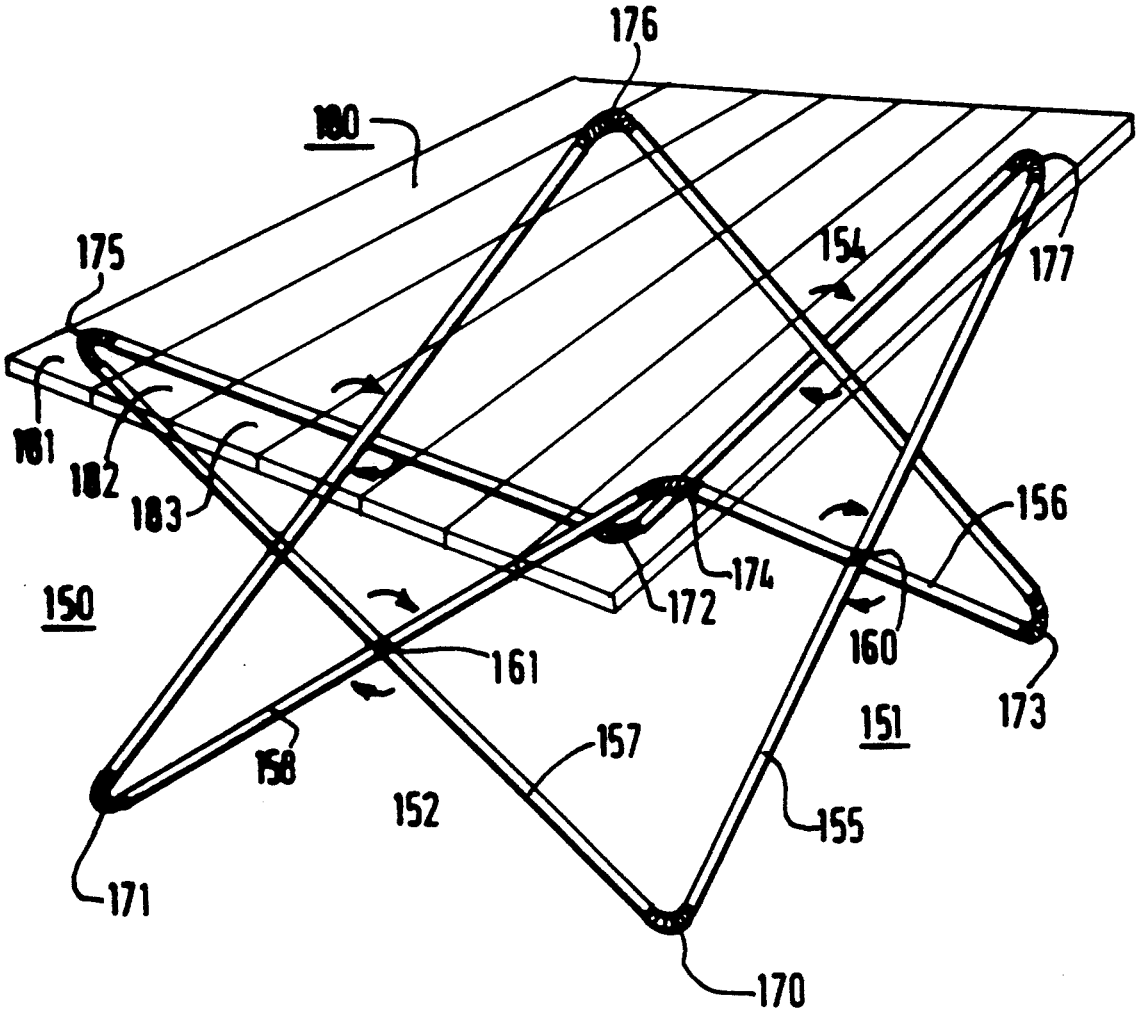
FIG. 9 shows an embodiment for a table.

In another embodiment shown in FIG. 9, the furni7 ture is a table. In this embodiment, the underframe indicated by the general reference (150) is formed of four equal cross-pieces (151,152,153,154), each formed of two struts, for example (155,156,157,158), joined two by two and for example at (160,161) and exhibiting at their ends the elastic deformable sleeves analogous to (120–125) or analogous to (30–38), respectively:

- the lower sleeves (170,171,172,173) intended to form feet and support on the ground;
- and the upper sleeves, respectively (174,175,176,177) intended to hold the support, namely the top.

The support forming the top, indicated by the general reference (180) is made up of a succession of parallel slats (181,182,183) connected to each other in such a way that they can be rolled up.

The lower internal side of the top (180) contains the means of attachment, such as tabs resulting from the mold or attached, intended to work together with the upper sleeves (174–177) to block the cross-pieces in position and thus adjust the height of the top (180) with respect to the ground.

As above, the assembly underframe (150) and top (180) is completely foldable.

Figure 10:
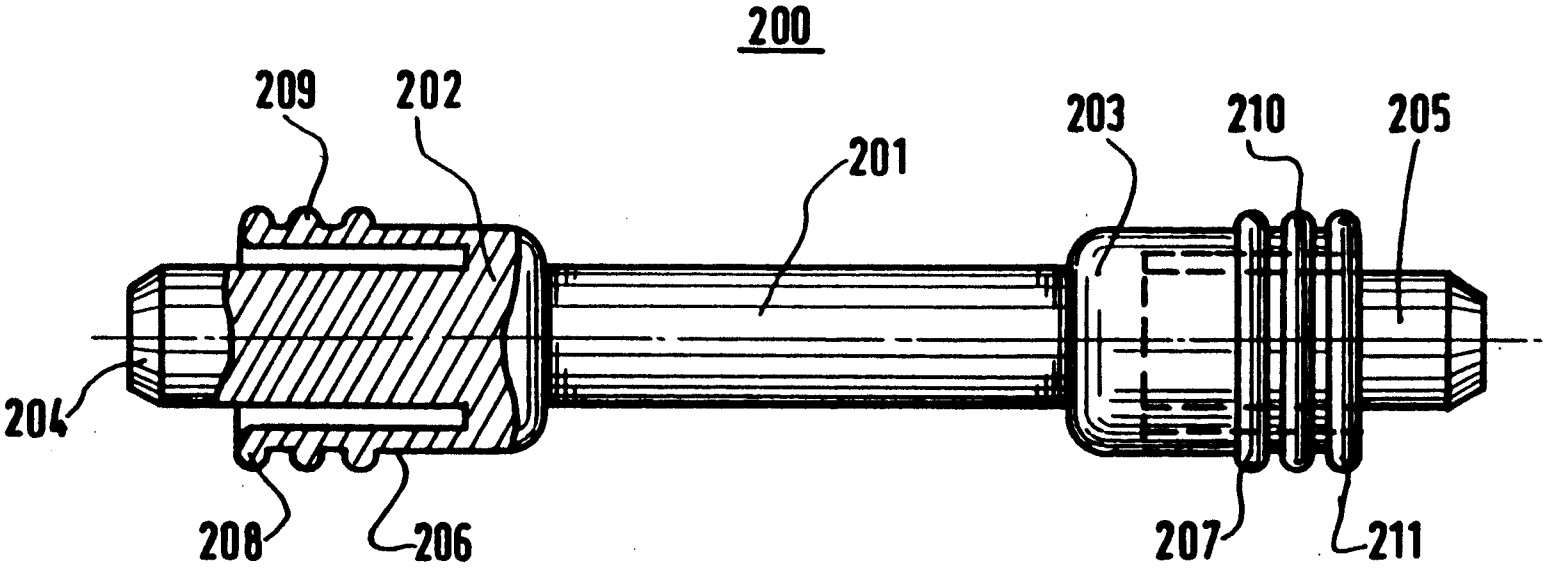
FIG. 10 shows a side view of a cross section of a preferred embodiment of the characteristic sleeve of unitary construction of the invention.

As already mentioned, FIG. 10 shows a preferred embodiment of the characteristic sleeve of unitary construction. This sleeve indicated by the general reference (200) is made up of a solid monobloc injection-molded piece of elastic thermoplastic material, for example of a polyurethane elastomer reinforced with fiber glass and colored.

The central body (201) exhibits at each of its ends heads (202) and (203), respectively, containing a bevelled male joining piece (204 and 205) that sticks out, of which the diameter corresponds essentially to the interior diameter of the cross-pieces in order to be force fit, and to the diameter of the body (201). These joining pieces (204,205), coaxial to the body (201), are encircled by a covering skit (206,207) creating with the joining piece a space corresponding to the thickness of the cross-pieces.

The ends of these skirts (206,207) exhibit tori (208-221) intended to perfect the adjustment of the skirt (206,207) on the end of the cross-pieces when they are folded or set up.

In one practical method of execution, the body and the joining pieces have a diameter of about fifteen millimeters, an overall length of 120 mm and each skirt has a length of 25 mm for an average diameter (apart from the tori) of 20 mm.

Figure 11:
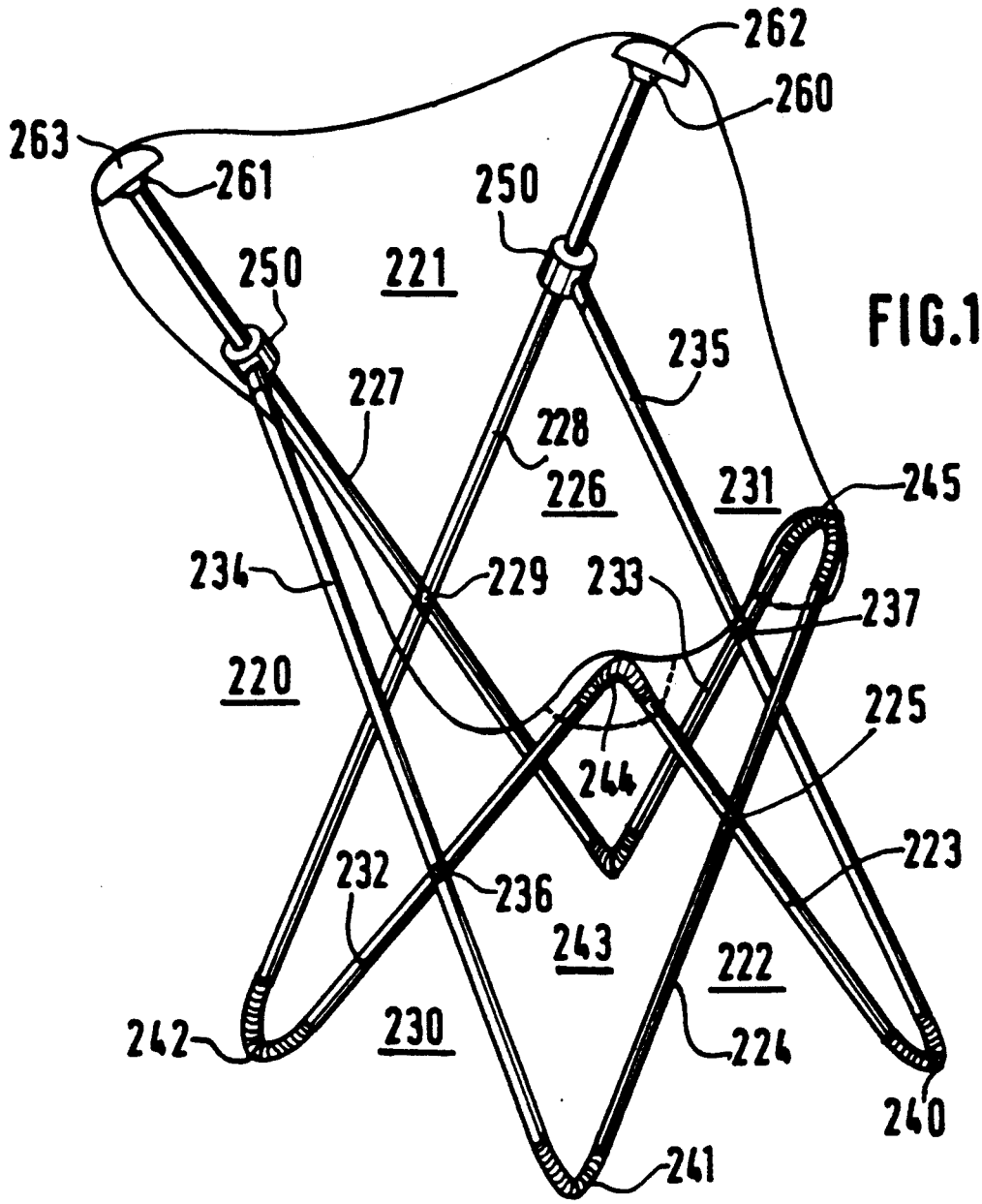
FIGS. 11 and 12 show an embodiment of a seat with four legs.
Figure 12:
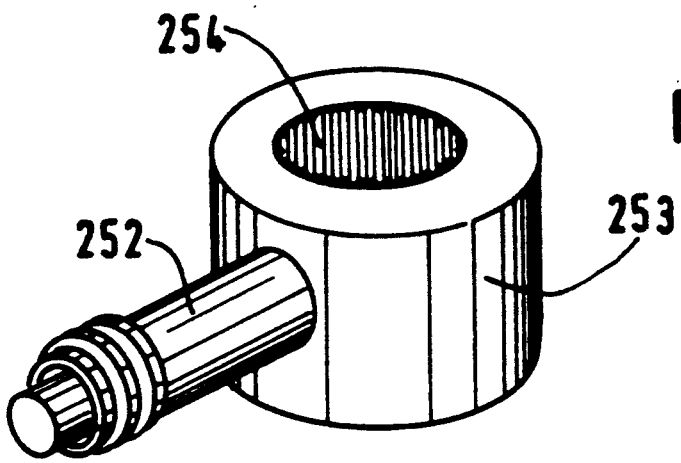

In an embodiment shown in FIGS. 11 and 12, the furniture is a four-legged seat, made up of a frame indicated by the general reference (220) and of a rectangular support cloth (221), constructed in the manner of the cloth (2).

The characteristic underframe (220) basically includes, as does (10), four cross-pieces, respectively:

- a front cross-piece (222) formed of two equal struts (223,224) joined at the middle (225);
- a rear cross-piece formed of two struts, also equal (227,228) joined at the middle (229), and larger than the front struts (223,224);
- of two side cross-pieces (230,231) made up of two small struts (232,233) equal to (223,224) and of two struts of intermediate length (234,235) each joined two by two at (236) and (237).

The lower ends of all the struts are connected to each other by fitted deformable elastic sleeves of unitary construction (240,243), intended to form a base on the ground. In the same way, the front upper ends are connected to each other by two analogous sleeves (244,245) on which the gussets that are not referenced rest, placed at two front corners of the support cloth (221) and analogous to (55,56).

In summary, in this embodiment, the two front struts (227,228) work together with the two intermediate side struts (234,235) by means of a slide (250,251) shown in detail in FIG. 12. This slide of unitary construction of a molded plastic material, for example of polyurethane, includes a joint (252) analogous to (201-209) in order to be fitted onto the upper end of the two intermediate side struts (227,228). This attachment is of unitary construction with a cylindrical ring (253) with a hole in its center having an opening (254) that is also cylindrical and of which the diameter is slightly greater than the diameter of the rear struts (227,228) in order to be able to slide onto them.

The upper ends (260,261) of the rear struts (227,228) hold a rounded support piece (262,263) for example of molded plastic material, notably of polypropylene, intended to come to rest in the two gussets not shown that are analogous to (53,54) in such a way that the rear part of the support cloth (221) forms the back.

The chairs and tables made according to the invention present a number of advantages in comparison to those currently on the market. The following can be mentioned:

- first and foremost the fact that the assembly is completely foldable, but easy to move and store;
- the fact that the lower sleeves in particular are of plastic material and not metal, they thus form runners which prevents digging up the ground; in addition, they also have a shock absorbing and anti-skid function;
- the fact that the upper sleeves are also of plastic material prevents abrasion of the cloth or the table top;
- since the characteristic elastic sleeves are deformable, they also form shock absorbers when the cloth is placed under tension and also contribute to the unfolding and set-up of the assembly;
- finally, the possibility of bending the sleeves completely (see FIG. 7), which permits totally folding the assembly and facilitates setting up and keeping the furniture folded thanks to the closing loop (60); this latter is continuously under tension, taking into account the set force of the sleeves.

I claim:

1. Foldable furniture, such as chairs, stools, easy chairs and tables, comprising an underframe and a support removably securable to the underframe to rest thereon, said underframe including at least three cross-pieces consecutively positioned adjacent one another, each of said cross-pieces having a pair of jointed articulating tubular rods, each of said rods having a lower end and an upper end, wherein adjacent lower ends of consecutive cross-pieces are connected in cooperative engagement with each other and adjacent upper ends of said consecutive cross-pieces are similarly connected to each other in cooperative engagement, each respective pair of adjacent ends being connected to each other by an elastic deformable sleeve of unitary construction having a mid-section, exhibiting a strong elastic return force, and securing into each pair of adjacent ends so that the sleeves connecting adjacent lower ends of consecutive cross-pieces of said underframe each form a rest for a ground surface, while the sleeves connecting adjacent upper ends of consecutive cross-pieces each form a rest for said support.

2. Furniture according to claim 1 wherein said elastic deformable sleeve is molded from an elastic deformable plastic material.

3. Furniture according to claim 2 wherein said plastic material forming the sleeve is selected from the group of elastomers including thermoplastic polyurethane, polyvinyl chloride, and rubber.

4. Furniture according to claim 2 wherein said elastic deformable sleeve is reinforced with textile fiber.

5. Furniture according to claim 2 wherein said underframe is comprised of four articulating cross-pieces including a front, a rear and two side cross-pieces, the rods of said front cross-piece being of an equal first predetermined length, the rods of said rear cross-piece being of an equal second predetermined length, the first length being shorter than the second length, and each of said side cross-pieces has one rod of the first length and the other rod of the second length.

6. Furniture according to claim 5 wherein said support is a trapezoidal or rectangular piece of flexible sheet material, the sheet material having a front edge, a rear edge, side edges, the edges forming four corners, and a gusset formed on each of the corners thereof so that the support is suspendable from the upper portion of the underframe by placing each of the two gussets formed on the rear edge of the flexible sheet over a corresponding sleeve secured to one of the upper ends of the rods forming the rear cross-piece and similarly placing each of the two gussets formed on the front edge of the sheet over a corresponding sleeve secured to one of the upper ends of the rods forming the front cross-piece.

7. Furniture according to claim 6 wherein each of said gussets and the sheet material adjacent thereto includes attachment means for securing said support to the upper portion of said underframe whereby when a respective gusset is placed over said corresponding sleeve, the gusset may be secured to the adjacent sheet material to retain the said sleeve within said respective gusset.

8. Furniture according to claim 1 wherein the elastic deformable sleeve includes an elongated central body member including said mid-section having at each end thereof a male portion, the male portion having an outside diameter substantially equal to the interior diameter of the rods of said cross-pieces so that each male end of the body member is insertible into each one of said pairs of adjacent rod ends of said cross-pieces by force fit, said mid-section of the central body member further having an outside diameter substantially equal to the outside diameter of the rods of said cross-pieces so that when the male portions of the body member are inserted into the adjacent ends of the consecutive cross-pieces, the mid-section is flush with the rods connected thereto and wherein each end of said adjacent ends of consecutive cross-pieces includes fastening means to secure a respective male portion within a corresponding rod end.

9. Furniture according to claim 1 wherein the elastic deformable sleeve includes an elongated central body member including said mid-section having at each end thereof a male portion having the shape of a truncated cone with a large base having a diameter substantially equal to the inside diameter of the rods of said cross-pieces and a small base joined to a respective end of said mid-section which has an outside diameter substantially equal to the outside diameter of the rods of said cross-pieces, each truncated cone-shaped male end of the body member being insertable into each one of said pairs of adjacent rod ends of said cross-pieces by force fit so that when a respective rod end is contracted to snugly secure a corresponding cone-shaped male portion from the large base to the small base, said mid-section will have a diameter slightly greater than the diameter of the respective rod end at a point immediately adjacent said mid-section.

10. Furniture according to claim 1 wherein said underframe is comprised of three articulating cross-pieces including a front and two side cross-pieces, the rods of said front cross-piece being of an equal first predetermined length, one of the rods of each of said side cross-pieces being of said first predetermined length and the other rod thereof being of a second predetermined length, the first length being shorter than the second length, said underframe thereby forming a stool with three feet formed by the deformable sleeves connecting adjacent lower ends of the consecutive cross-pieces and three upper projections, including one rear and two front projections, formed by the deformable sleeves connecting adjacent upper ends of the consecutive cross-pieces.

11. Furniture according to claim 10 wherein said support is a triangular piece of flexible sheet material, the sheet material having a front edge, two side edges, the edges thereby forming three corners, and a gusset formed on each of the corners thereof so that said support is suspendable from the upper projections of the underframe by placing each of the two gussets formed on the front edge of the flexible sheet over a corresponding one of the front projections and similarly placing the remaining gusset over the rear projection.

12. Furniture according to claim 1 wherein said underframe is comprised of four articulating cross-pieces including a front, a rear, and two side cross-pieces, the rods of the cross-pieces being of an equal predetermined length, said underframe thereby forming a base with four feet formed by the deformable sleeves connecting adjacent lower ends of the consecutive cross-pieces and four upper projections formed by the deformable sleeves connecting adjacent upper ends of the consecutive cross-pieces.

13. Furniture according to claim 12 wherein said support is a rectangular top having an underside and being formed from interconnected parallel slats that are capable of being unconnected and rolled up for storage and transport, said rectangular top further being mountable upon said four upper projections to form a table.

14. Furniture according to claim 13 wherein the underside of said top is provided with attachment means for retaining the upper projections at different locations relative to said top so that the table height is adjustable.

15. A foldable easy chair comprising an underframe and a support removedly securable to the underframe to rest thereon, said underframe having four cross-pieces positioned consecutively adjacent one another, each of said cross-pieces having a pair of jointed articulating tubular rods, each of said rods having a lower end and an upper end, wherein the four cross-pieces include a front, a rear and two side cross-pieces positioned between said front and rear cross-pieces, the rods of said front cross-piece being of an equal first predetermined length, the rods of said rear cross-piece being of an equal second predetermined length, the first length being shorter than the second length, each of said side cross-pieces has one of its rods being of the first length and the other rod being of the second length, and adjacent lower ends of the rods are connected to each other by an elastic deformable sleeve of unitary construction having a mid-section, exhibiting a strong elastic return force, and securing into each pair of lower adjacent ends so that each of the lower sleeves forms a rest for a ground surface, each upper end of the front cross-piece being connected by said deformable sleeve to an adjacent upper end of each shorter rod of the side cross-pieces, while the upper end of each longer rod of the side cross-pieces is connected to a protruding joint formed on an outer circumference of a cylindrical ring that is adjustably slidable up and down an upper portion of a corresponding rod of the rear cross-piece.

16. The foldable easy chair according to claim 15 wherein each upper end of the rods forming the rear cross-piece includes a rounded shoulder piece and said support is a trapezoidal or rectangular piece of flexible sheet material, the sheet material having a front edge, a rear edge, side edges, the edges forming four corners, and a gusset formed on each of the corners thereof so that the support is suspendable from the upper portion of the underframe by placing each of the two gussets formed on the rear edge of the flexible sheet over a corresponding shoulder piece and similarly placing each of the two gussets formed on the front edge of the sheet over a corresponding sleeve secured to one of the upper ends of the rods forming the front cross-piece.

17. The foldable easy chair according to claim 16 wherein said cylindrical ring is of unitary construction being of a molded plastic material such as polyuethane and said rounded shoulder piece is molded from polypropylene.

18. The foldable easy chair according to claim 15 wherein said elastic deformable sleeve is molded from an elastic deformable plastic material.

19. The foldable easy chair according to claim 18 wherein said plastic material forming the sleeve is selected from the group of elastomers including thermoplastic polyurethane, polyvinyl chloride, and rubber.

20. The foldable easy chair according to claim 18 wherein said elastic deformable sleeve is reinforced with textile fiber.

* * * * *